US012729526B2

(12) United States Patent
Fan et al.

(10) Patent No.: US 12,729,526 B2
(45) Date of Patent: Sep. 8, 2026

(54) MAGNETIC SUSPENSION DRAIN

(71) Applicant: Lixil (China) Investment Co., Ltd., Shanghai (CN)

(72) Inventors: Zhongde Fan, Shanghai (CN); Li Jiang, Shanghai (CN); Junyan Xu, Shanghai (CN); Tiantao Li, Shanghai (CN)

(73) Assignee: Lixil (China) Investment Co., Ltd., Shanghai (CN)

( * ) Notice: Subject to any disclaimer, the term of this patent is extended or adjusted under 35 U.S.C. 154(b) by 273 days.

(21) Appl. No.: 18/136,147

(22) Filed: Apr. 18, 2023

(65) Prior Publication Data

US 2023/0340767 A1 Oct. 26, 2023

(30) Foreign Application Priority Data

Apr. 26, 2022 (CN) ..... 202221015299.4

(51) Int. Cl.
*E03C 1/23* (2006.01)

(52) U.S. Cl.
CPC ..... *E03C 1/23* (2013.01); *E03C 2001/2311* (2013.01)

(58) Field of Classification Search
CPC . E03C 1/23; E03C 1/262; E03C 1/282; E03C 2001/2311; E03F 5/0407; E03F 5/0408
See application file for complete search history.

(56) References Cited

U.S. PATENT DOCUMENTS 5,363,519 A * 11/1994 Husting ..... E03C 1/23 4/689
10,865,552 B2 * 12/2020 Homami ..... E03C 1/2306

FOREIGN PATENT DOCUMENTS

CN 2145216 Y 11/1993
CN 2673958 Y 1/2005
CN 2742048 Y 11/2005
CN 2858798 Y 1/2007
(Continued)

*Primary Examiner* — Erin Deery
(74) *Attorney, Agent, or Firm* — Morrison & Foerster LLP

(57) ABSTRACT

The present utility model provides a magnetic suspension drain, comprising a first connecting member and a second connecting member that are connected with each other and adapted to respective connection to a drain opening of a drain device and a drain pipe. The magnetic suspension drain further comprises a magnetic suspension inner core arranged in the first connecting member, and the magnetic suspension inner core comprises a rotary floating rod and a rotary sealing cover. The rotary floating rod is provided with a first magnet, and a repulsive second magnet is provided inside the first connecting member. The magnetic suspension inner core is configured as follows: in a sealed state, the rotary floating rod drives the rotary sealing cover to maintain sealing with a drain end of the first connecting member under the action of a repulsive force of the first magnet and the second magnet; and in a draining state, the rotary sealing cover is disengaged from the sealing with the drain end of the first connecting member under the action of water pressure and rotates along with the water flow to promote drainage. The present utility model provides a magnetic suspension inner core that utilizes magnetism to realize automatic sealing and drainage, and rotates along with the water flow during drainage to promote drainage through the rotary floating rod and the rotary sealing cover that are integrated into one whole piece.

20 Claims, 6 Drawing Sheets

(56) References Cited

FOREIGN PATENT DOCUMENTS

| | | | | | |
|---|---|---|---|---|---|
| CN | 201148657 | Y | | 11/2008 | |
| CN | 101328717 | A | | 12/2008 | |
| CN | 101768998 | A | | 7/2010 | |
| CN | 202248139 | U | | 5/2012 | |
| CN | 202577501 | U | | 12/2012 | |
| CN | 204040170 | U | | 12/2014 | |
| CN | 204510437 | U | | 7/2015 | |
| CN | 207003613 | U | | 2/2018 | |
| CN | 209179148 | U | | 7/2019 | |
| CN | 210177649 | U | | 3/2020 | |
| CN | 211257229 | U | | 8/2020 | |
| CN | 111945861 | A | | 11/2020 | |
| CN | 212670783 | U | | 1/2021 | |
| CN | 212956866 | U | * | 4/2021 | |
| CN | 212956867 | U | | 4/2021 | |
| CN | 214784445 | U | | 11/2021 | |
| EP | 2281955 | A1 | * | 2/2011 | ..... E03C 1/2306 |
| EP | 2302141 | A2 | | 3/2011 | |
| KR | 100742006 | B1 | * | 7/2007 | |
| KR | 2020170002282 | U | | 6/2017 | |
| WO | WO2021012632 | A1 | | 1/2021 | |

* cited by examiner

MAGNETIC SUSPENSION DRAIN

FIELD OF THE UTILITY MODEL

The present utility model relates to the technical field of bathroom fixtures, and more specifically, to a magnetic suspension drain.

DESCRIPTION OF THE RELATED ART

Sanitary appliances with drains, such as basins, tubs, and water tanks, are bathroom fixtures extensively used in daily life, and a drainage assembly thereof mainly comprises a drain or a drain apparatus. Taking a basin as an example, a drain apparatus is disposed between a drain opening at the bottom of the basin and an external drainpipe, and typically comprises a spring valve core and a sealing member connected with the spring valve core. When the spring valve core is pressed to squeeze the sealing member, the sealing member is sealed with the drain opening to store water, and when the spring valve core is pressed again to reset, the sealing member is disengaged from the sealing with the drain opening, resulting in a gap that realizes drainage.

With the improved living standard, user requirements for drainage functions are increasingly high, and drain apparatuses with anti-odor, hair collection, and other functions become gradually popular among users.

SUMMARY OF THE UTILITY MODEL

The objective of the present utility model is to provide a magnetic suspension drain, which is intended to achieve anti-odor, foreign matter collection, and other functions through a compact structure, and to improve user experience and satisfaction.

Thus, the present utility model provides a magnetic suspension drain, comprising a first connecting member and a second connecting member that are connected with each other and adapted to respective connection to a drain opening of a drain device and a drain pipe, and further comprising a magnetic suspension inner core arranged in the first connecting member, the magnetic suspension inner core comprising a rotary floating rod and a rotary sealing cover connected with the rotary floating rod, wherein the rotary floating rod is provided with a first magnet, a repulsive second magnet is provided inside the first connecting member, and the magnetic suspension inner core is configured as follows: in a sealed state, the rotary floating rod drives the rotary sealing cover to maintain sealing with a drain end of the first connecting member under the action of a repulsive force of the first magnet and the second magnet; and in a draining state, the rotary sealing cover is disengaged from the sealing with the drain end of the first connecting member under the action of water pressure and rotates along with the water flow to promote drainage.

According to the above-described technical concept, implementation manners of the present utility model may comprise any one or more of the following optional forms.

In some optional forms, the rotary floating rod is constructed to be a hollow rod, the first magnet is arranged inside the hollow rod or sleeves outside the hollow rod and is adjacent to a first end of the rotary floating rod, and the rotary sealing cover is connected, via a connecting member, to an opposing second end of the rotary floating rod.

In some optional forms, the rotary sealing cover is constructed to have an inverted bowl shape convex toward the rotary floating rod, comprising a curved convex part and a ring-shaped connecting part formed at the edge of the curved convex part, and the ring-shaped connecting part is adapted to sealed connection with the drain end of the first connecting member.

In some optional forms, a water guide part is provided on the external surface of the curved convex part, and the water guide part comprises a plurality of ridges extending radially to spread out and deflecting circumferentially, so as to form a spiral texture.

In some optional forms, an inwardly recessed installation part is provided at the center of the curved convex part, and the second end of the rotary floating rod is inserted into the installation part.

In some optional forms, the magnetic suspension drain further comprises a removable collector arranged connectedly inside the first connecting member and attached to the magnetic suspension inner core, wherein the collector is provided with an accommodation cavity suitable for accommodating the rotary floating rod, and the second magnet is arranged at an opening end of the accommodation cavity, causing the rotary floating rod to reciprocate along the accommodation cavity.

In some optional forms, the second magnet is fixed to the opening end of the accommodation cavity through a sealing end cover, and the rotary floating rod is accommodated inside the accommodation cavity through a through hole of the sealing end cover, wherein the first end of the rotary floating rod is provided with an external flange, and in the draining state, the external flange engages with the sealing end cover to limit the moving range of the rotary floating rod.

In some optional forms, the second magnet sleeves over the rotary floating rod, and in the draining state, the external flange abuts the second magnet.

In some optional forms, a ring-shaped internal flange is provided at the drain end of the first connecting member, and the collector is provided with a ring-shaped shoulder for abutting the ring-shaped internal flange.

In some optional forms, the ring-shaped connecting part of the rotary sealing cover is adapted for sealed connection with the end surface of the ring-shaped shoulder of the collector, and the outer diameter of the ring-shaped connecting part is greater than the inner diameter of the ring-shaped shoulder and smaller than the inner diameter of the ring-shaped internal flange of the first connecting member.

In some optional forms, the magnetic suspension drain further comprises a spring valve core arranged at a water incoming end of the first connecting member.

In some optional forms, the drain device comprises a basin, a tub, or a water tank.

The magnetic suspension drain according to the present utility model provides a magnetic suspension inner core that utilizes magnetism to realize automatic sealing and drainage of the drain, and improves user experience by setting the magnetic suspension inner core to comprise the rotary floating rod and the rotary sealing cover that are integrated into one whole piece and to rotate along with the water flow during drainage to promote drainage. This magnetic suspension drain is easy to implement, is easy to install and disassemble, has significantly improved scaling performance and drainage performance, and can be used in a variety of occasions.

BRIEF DESCRIPTION OF THE DRAWINGS

Other features and advantages of the present utility model can be better understood through the following detailed description of optional embodiments with reference to the accompanying drawings. Identical reference numerals in the accompanying drawings refer to identical or similar parts, wherein.

DETAILED DESCRIPTION OF THE EMBODIMENT

Figure 1:
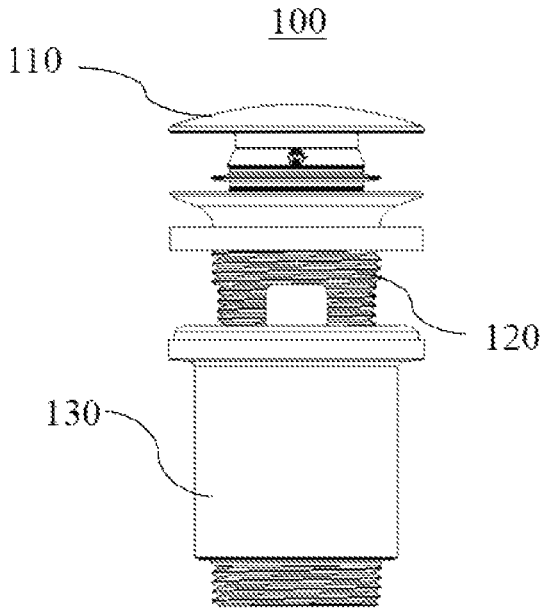
FIG. 1 is a schematic diagram of a magnetic suspension drain according to an embodiment of the present utility model.

Implementations and uses of the embodiments will be described in detail below. However, it should be understood that the discussed specific embodiments only exemplarily describe particular manners in which the present utility model is implemented and used, and do not limit the scope of the present utility model. When structural positions of various parts are described, the expressions of directions, such as upper, lower, top, and bottom, are not absolute, but relative. These directional expressions are proper when the parts are arranged as shown in the figures, but when the positions of the parts change in the figures, these directional expressions also change accordingly.

Here, the expression "comprising" or similar expressions with the same meaning, such as "including," "containing," and "having," are open and do not exclude additional elements, steps, or parts that are not listed. The expression "consisting of . . . " excludes any elements, steps, or parts that are not identified. The expression "substantially consisting of . . . " means that the scope is limited to the specified elements, steps, or parts, plus optional elements, steps, or parts that do not substantially affect the basic and new features of the claimed subject matter. It should be understood that the expression "comprising" encompasses the expressions "substantially consisting of . . . " and "consisting of . . . ".

Here, terms "install," "connect," and "attach" should be understood in their broad meanings, unless otherwise specifically defined. For example, it can be a fixed connection, or a removable connection, or an integral whole; it can be a direct connection, or an indirect connection via an intermediate medium, or internal communication between two elements, or an interaction relationship between two elements. A person skilled in the art can understand the specific meaning of the above terms herein according to specific situations.

Here, terms "first," "second," and the like are not used to define a sequence or the number of components, unless otherwise defined.

Here, the axial direction of a tubular or ring-shaped part refers to a direction along the central axis of the part, the circumferential direction of a tubular or ring-shaped part refers to a direction along the circumference of the part, and the radial direction of a tubular or ring-shaped part refers to a direction passing through the central axis of the part and perpendicular to the axial direction of the part.

A conventional drain used on a drain device is typically not provided with an anti-odor structure; instead, the anti-odor function is realized through storing water in a conventional elbow water seal. As a result, a relatively large installation space is required for the drain assembly of a drain device, thereby taking up the storage space underneath the drain device. In addition, most of existing drains are not provided with a filter device, and consequently foreign matters, such as hair, easily and directly enter the drainpipe during water discharge, making it difficult to clean, leading to clogging of the drain pipe after use over a long period of time, and affecting the normal water discharge rate and causing odor. All the above phenomena severely affect the use comfort and experience of users.

Thus, by adding a magnetic suspension inner core in a drain, the present utility model achieves good sealing effect with the reasonable structural design and with no need for elbow water seal, and realizes anti-odor and backflow prevention functions. At the same time, the present utility model further achieves the function of accelerated drainage during the drain process. On the basis of this, in combination with the design of a collector and by combining a collector with the magnetic suspension inner core, the magnetic suspension drain according to the present utility model has features of easy installation, easy cleaning, fast drainage, and good sealing.

Figure 2:
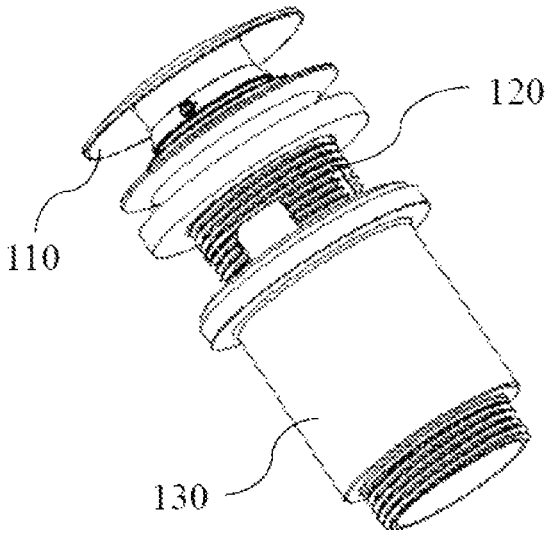
FIG. 2 is a schematic diagram of the magnetic suspension drain illustrated from another angle.
Figure 7:
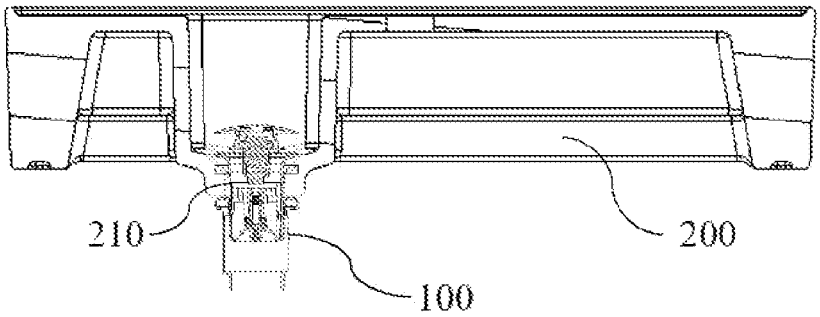
FIG. 7 is a cross-sectional view of the magnetic suspension drain shown in FIG. 1 installed in a basin.

On the basis of the above concept, FIG. 1 and FIG. 2 illustrate, from different angles, a magnetic suspension drain 100 according to an embodiment of the present utility model, comprising a first connecting member 120 and a second connecting member 130 that are connected with each other and adapted to respective connection to a drain opening of a drain device and a drain pipe. In combination with FIG. 3 and FIG. 7, the first connecting member 120 and the second connecting member 130 are cylindrical parts, the first connecting member 120 is partially installed inside the second connecting member 130 in, for example, a threaded connecting manner, and comprises a water incoming end 121 and a water discharging end 122, and the water incoming end 121 is arranged with a spring valve core 110 for realizing water storage and water discharge of the drain device through elastic press and elastic reset after pressing again. As illustrated, the external side of the water incoming end 121 of the first connecting member 120 is provided with a flange 123, the flange 123 is typically arranged on the upper end surface of the drain opening 210 of the drain device 200, and sealing is realized by clamping a first sealing ring 160 between the flange 123 and the upper end surface of the drain opening 210. An installation end of the second connecting member 130 toward the first connecting member 120 is provided with an external flange 131, and sealing is realized by clamping a second sealing ring 170 and an optional gasket 180 between the external flange 131 and the lower end surface of the drain opening 210. In this way, after the drain pipe is connected to the threaded end of the second connecting member 130, the sealed connection between the drain device and the drain pipe can be realized.

It should be understood that the drain device herein is illustrated and described with a basin as an example, but it does not exclude that the drain device is a tub, a water tank, or other applicable bathroom devices or kitchen devices. In addition, conventional known parts may be used for the spring valve core 110, the first connecting member 120, and the second connecting member 130, which will not be repeated herein.

Figure 3:
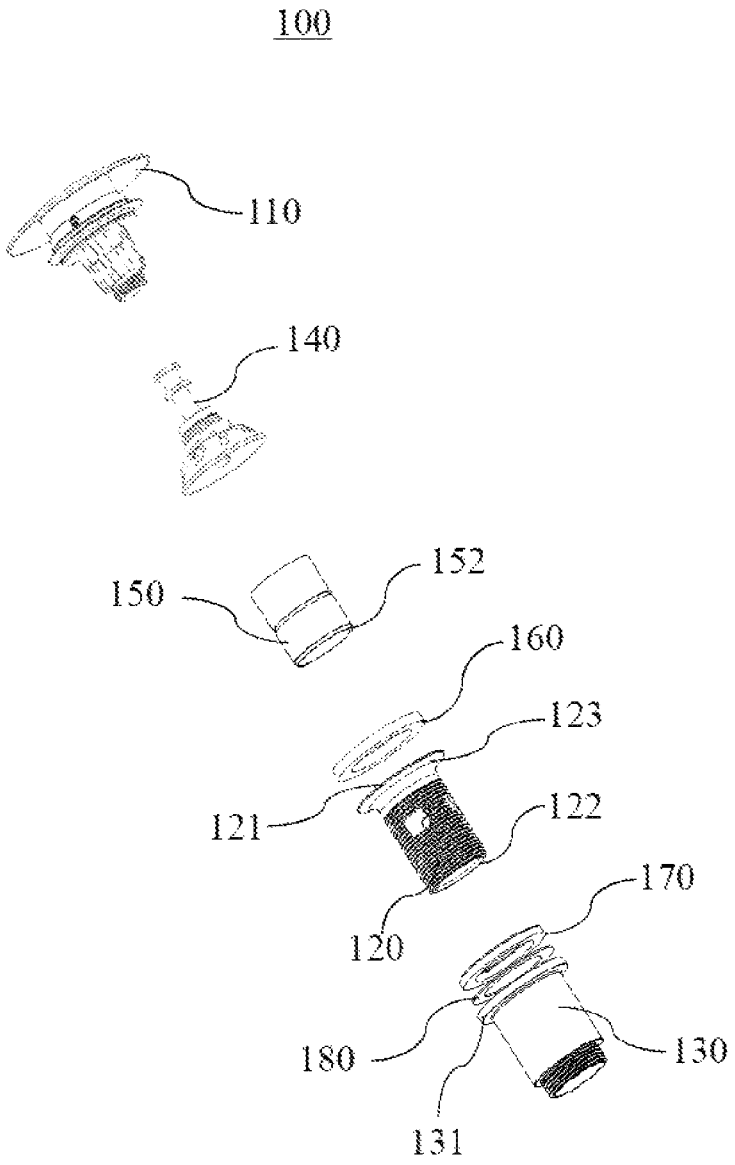
FIG. 3 is an exploded view of the magnetic suspension drain shown in FIG. 2.

As shown in FIG. 3, the magnetic suspension drain 100 according to the present utility model further comprises a magnetic suspension inner core 140 and a collector 150, uses the magnetic suspension inner core to realize the anti-odor sealing function, and uses the collector to realize the function of collecting foreign matters. In some embodiments, the magnetic suspension inner core and the collector are advantageously integrated with each other, such that the sealing and anti-odor effects, as well as easy installation and disassembly, can be achieved in a compact manner, thereby improving the user experience.

Figure 4:
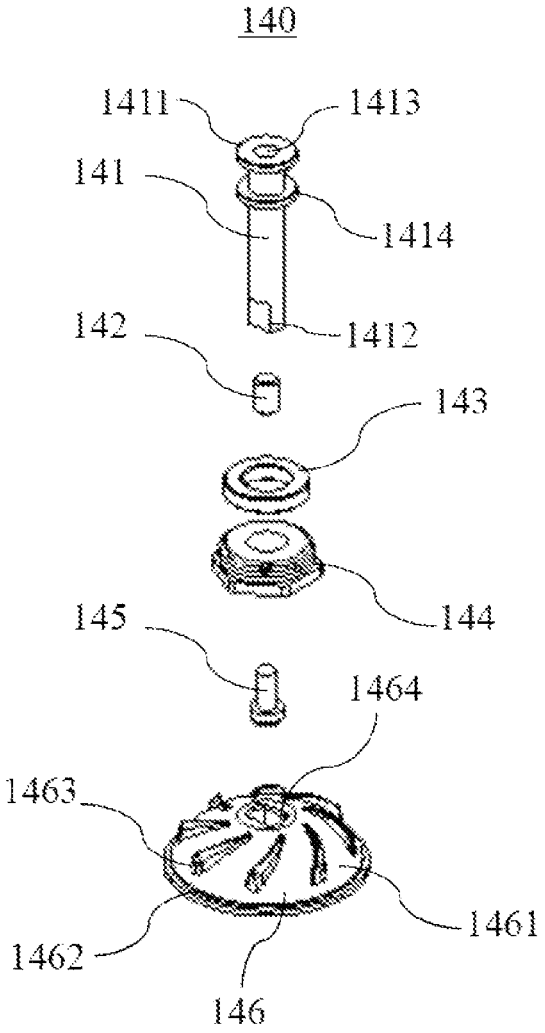
FIG. 4 is an exploded view of a magnetic suspension inner core in the magnetic suspension drain shown in FIG. 3.

Specifically, an embodiment of the magnetic suspension inner core shown in FIG. 4 is referenced. The magnetic suspension inner core 140 is adapted to being arranged inside the first connecting member 120 and comprises a rotary floating rod 141 and a rotary sealing cover 146 connected with the rotary floating rod 141, wherein the rotary floating rod 141 is provided with a first magnet 142, and a repulsive second magnet 143 may be provided at a proper position inside the first connecting member 120. In this way, when the magnetic suspension inner core 140 is installed into the first connecting member 120, it can be switched between a sealed state and a draining state through magnetic action. Here, in the sealed state, the rotary floating rod 141 drives the rotary sealing cover 146 to maintain sealing with a drain end of the first connecting member under the action of a repulsive force of the first magnet 142 and the second magnet 143; and in the draining state, the rotary sealing cover 146 is disengaged from the sealing with the drain end of the first connecting member under the action of water pressure and rotates along with the water flow to promote drainage. This will be described in further detail below.

Figure 5:
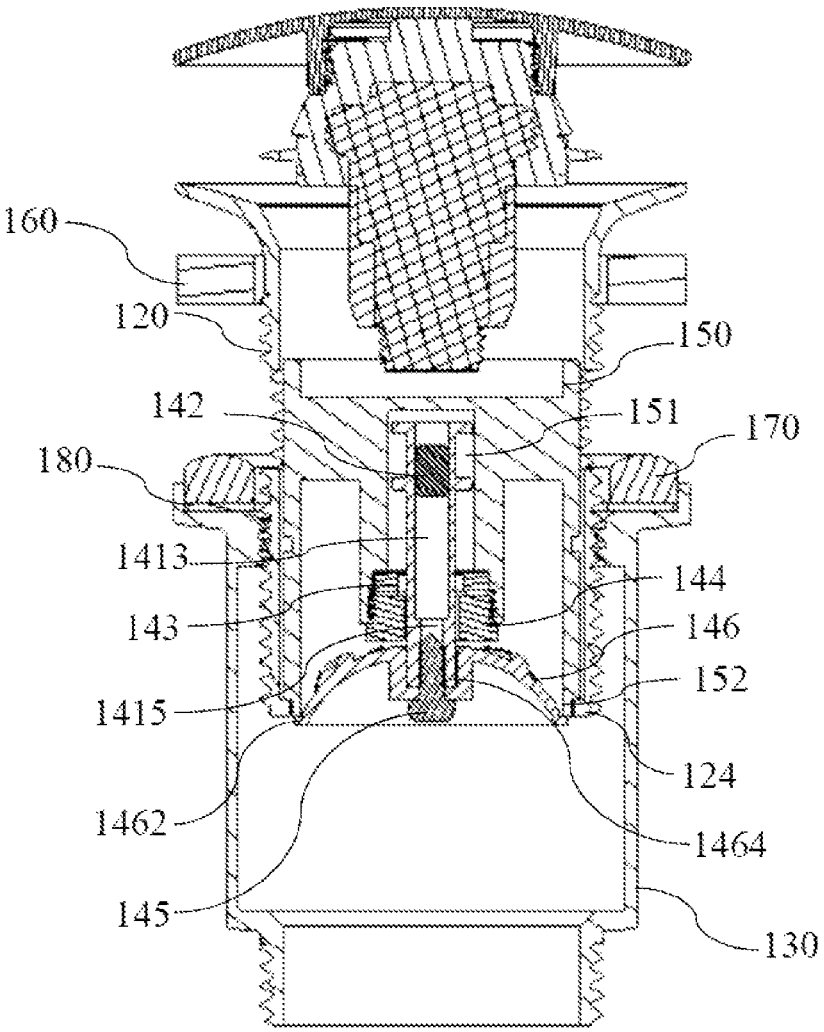
FIG. 5 is a cross-sectional view of the magnetic suspension drain shown in FIG. 1, which shows a sealed state.

In combination with FIG. 4 and FIG. 5, in some embodiments, the rotary floating rod 141 is constructed to be a hollow rod, that is, a cylindrical shape with an inner cavity 1413, and a first end 1411 and an opposing second end 1412. The first magnet 142 is of, for example, a block shape, and is arranged inside the inner cavity 1413 of the hollow rod and adjacent to the first end 1411 of the rotary floating rod. Alternatively, in some embodiments, the first magnet may be constructed to be ring shaped and sleeve outside the hollow rod. For example, the first end 1411 of the rotary floating rod 141 is provided with an external flange 1414, and this external flange may be a pair of external flanges that are spaced apart as shown in FIG. 4, thereby sandwiching the ring-shaped first magnet therebetween. The rotary sealing cover 146 is connected, via a connecting member, to the second end 1412 of the rotary floating rod 141. The connecting member is, for example, the pin 145 as shown, one end of which runs through a hole on the rotary sealing cover 146 and is inserted into a connection hole 1415 inside the rotary floating rod 141, and the other end is a head with an increased size, thereby connecting the rotary sealing cover 146 and the rotary floating rod 141. The motion of the rotary floating rod 141 can drive the rotary sealing cover 146 to move synchronously, thereby improving the operation reliability of the magnetic suspension inner core.

In the illustrated embodiment, the rotary sealing cover 146 is constructed to have an inverted bowl shape convex toward the rotary floating rod 141, comprising a curved convex part 1461 and a ring-shaped connecting part 1462 formed at the edge of the curved convex part 1461, and the ring-shaped connecting part 1462 is adapted to sealed connection with the drain end of the first connecting member 120. In some embodiments, an inwardly recessed installation pad 1464 is provided at the center of the curved convex part 1461, such that the second end 1412 of the rotary floating rod 141 can be inserted into the installation part 1464, thereby reducing the longitudinal size of the magnetic suspension inner core 140 and thus favoring the reduction of the overall size of the magnetic suspension drain. It should be understood here that the inner side and the outer side of the curved convex part are relative to the bowl shape, where the "inner" refers to a direction pointing toward the interior of the bowl shape, and the "outer" refers to a direction pointing toward the exterior of the bowl shape. In addition, the rotary sealing cover may be made of a material having certain deformation characteristics, such as plastics or rubber, so as to help improve the sealing performance.

Advantageously, a water guide part 1463 is provided on the external surface of the curved convex part 1461 of the rotary sealing cover 146 according to the present utility model, and as shown in FIG. 4, the water guide part 1463 comprises a plurality of ridges extending radially to spread out and deflecting circumferentially, so as to form a spiral texture. In this way, when a water flow hits on the external surface of the curved convex part 1461, the water guide part 1463 can deflect and guide the water flow such that the rotary sealing cover 146 rotates along with the water flow, thereby increasing the water discharging rate. According to actual measurements, the water discharging rate is around 41 l/min.

In a preferred embodiment, a removable collector 150 is arranged connectedly inside the first connecting member 120 and attached to the magnetic suspension inner core 140. It should be understood that the "connectedly" here means that the collector is provided with structures for a water flow to pass without any adverse impact on drainage, and these structures also play a role of filtering to ensure that foreign matters, such as hair, are collected on the collector and do not fall off, thereby achieving the functions of a hair collector. In an embodiment as shown in FIG. 5, the collector 150 is provided with an accommodation cavity 151 suitable for accommodating the rotary floating rod 141. In this manner, the second magnet may be arranged at an opening end of the accommodation cavity 151, and the rotary floating rod 141 is driven, by the interaction between the second magnet and the first magnet 142 arranged at the first end 1411 of the rotary floating rod 141, to reciprocate inside the accommodation cavity 151.

Figure 6:
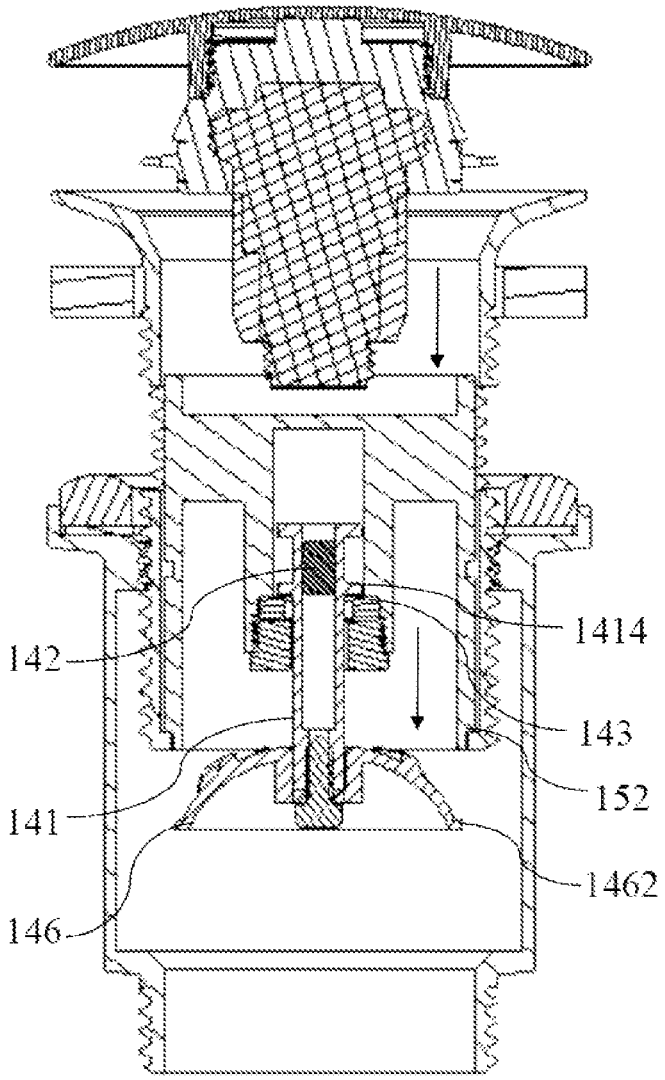
FIG. 6 is a cross-sectional view of the magnetic suspension drain shown in FIG. 1, which shows a draining state.

In some embodiments, the second magnet is fixed to the opening end of the accommodation cavity 151 through a sealing end cover, the second magnet is optionally a block-shaped magnet embedded at the opening end, and the sealing end cover is, for example, connected by means of threads, to the opening end, thereby fixing the second magnet. In the embodiment as shown in FIG. 4 and FIG. 5, the second magnet 143 is optionally constructed to be ring shaped and sleeves over the rotary floating rod 141. The rotary floating rod 141 runs through a through hole of the sealing end cover 144 and is accommodated inside the accommodation cavity 151, wherein the external flange 1414 of the first end 1411 of the rotary floating rod 141 can engage with the second magnet 143 or the sealing end cover 144 to limit the moving range of the rotary floating rod 141 in the draining state, as shown in FIG. 6.

In combination with FIG. 3 and FIG. 5, a ring-shaped internal flange 124 is provided at the drain end 122 of the first connecting member 120, and the collector 150 is provided with a ring-shaped shoulder 152 for abutting the ring-shaped internal flange 124. Advantageously, the ring-shaped connecting part 1462 of the rotary sealing cover 146 is adapted for sealed connection with the end surface of the ring-shaped shoulder 152 of the collector 150, and the ring-shaped connecting part 1462 does not extend beyond the end surface of the ring-shaped shoulder of the collector 150. In other words, the outer diameter of the rotary sealing cover 146 is greater than the inner diameter of the ring-shaped shoulder of the collector 150 and smaller than the inner diameter defined by the ring-shaped internal flange 124 of the first connecting member 120. In this way, the magnetic suspension inner core 140 and the collector 150 are actually integrated into one whole piece, and can be easily taken out from the water incoming end of the first connecting member 120, thereby facilitating the overall installation, disassembly, and cleaning.

An operating mode of the magnetic suspension drain according to the present utility model will be described below in combination with FIG. 5 and FIG. 6.

First, refer to the initial state or the sealed state shown in FIG. 5, when there is no water flowing through the drain, the rotary floating rod 141 is away from the second magnet 143 and disposed above the accommodation cavity 151 of the collector 150 due to the repulsive force of the first magnet 142 and the second magnet 143. At this moment, the rotary sealing cover 146 in connection with the rotary floating rod 141 is in sealed connection with the end surface of the ring-shaped shoulder 152 of the collector 150 and prevents odor, wastewater backflow, or bugs from entering the basin via the first connecting member 120.

When there is water flowing down and through the drain along the arrow direction in FIG. 6, the rotary sealing cover 146 moves downward by overcoming the magnetic force under the action of water pressure, is disengaged from the sealing with the end surface of the ring-shaped shoulder 152 of the collector 150, and results in a gap, such that the water is smoothly discharged via the gap. Moreover, the rotary floating rod 141 in connection with the rotary sealing cover 146 moves together downward and approaches the second magnet 143, and when the external flange 1414 of the rotary floating rod 141 abuts the second magnet 143, the rotary sealing cover 146 is limited from continued moving downward. In the water discharging process, due to the water guide part with the spiral texture on the rotary sealing cover 146, the rotary sealing cover 146 rotates along with the water flow, thereby increasing the water discharging rate. When the water discharge is completed, the repulsive force of the first magnet 142 and the second magnet 143 once again causes the rotary floating rod 141 to move upward and reset, which consequently drives the rotary sealing cover 146 to move upward and be in the sealed state again.

As can be seen from the above description, the magnetic suspension inner core of the magnetic suspension drain according to the present utility model can be installed or disassembled as one whole piece, which facilitates the use by users, and has a small volume, which saves the installation space compared with the space taken up by regular elbow water seals under conventional basins, and improves space utilization underneath the basin. When integrated with a collector in use, the removable collector can collect hair and foreign matters, which facilitates a user to take out the collector from the basin for cleaning, thereby preventing the drainpipe from being clogged. The magnetic suspension drain according to the present utility model has features of reasonable structural design, easy installation, fast drainage, and good sealing, improves the use comfort and experience, and is applicable to a variety of application environments.

It should be understood here that the embodiments shown in the figures only illustrate optional architectures, shapes, sizes, and arrangements of various optional parts of the magnetic suspension drain according to the present utility model, which are only exemplary rather than limitations. Other shapes, sizes, and arrangements may also be adopted without departing from the idea and scope of the present utility model.

The technical content and technical features of the present utility model have been disclosed above. However, it can be understood that given the creative idea of the present utility model, a person skilled in the art can make various changes and improvements to the concept disclosed above, all of which nevertheless fall within the scope of protection of the present utility model. The description of the above embodiments is exemplary, not restrictive, and the scope of protection of the present utility model shall be determined by the claims.

The invention claimed is:

1. A magnetic suspension drain, comprising a first connecting member and a second connecting member that are connected with each other and adapted to respective connection to a drain opening of a drain device and a drain pipe, and a magnetic suspension inner core arranged in the first connecting member, the magnetic suspension inner core comprising a rotary floating rod and a rotary sealing cover connected with the rotary floating rod, wherein the rotary floating rod is provided with a first magnet, a repulsive second magnet is provided inside the first connecting member, wherein the magnetic suspension inner core is configured such that in a sealed state, the rotary floating rod drives the rotary sealing cover to maintain sealing with a drain end of the first connecting member under the action of a repulsive force of the first magnet and the second magnet; and in a draining state, the rotary sealing cover is disengaged from the sealing with the drain end of the first connecting member and extends within the second connecting member under the action of water flow and rotates along with the water flow to promote drainage, wherein the first connecting member has a first flange on an outer side of a water inlet end of the first connecting member, the second connecting member has second flange on an outer side of an end of the second connecting member facing the first connecting member, a first seal is achieved by clamping a first sealing ring between the first flange and an upper end surface of the drain opening, and a second seal is achieved by clamping a sealing ring between the second flange and a lower end surface of the drain opening.

2. The magnetic suspension drain according to claim 1, wherein the rotary floating rod is constructed to be a hollow rod, the first magnet is arranged inside the hollow rod or sleeves outside the hollow rod and is adjacent to a first end of the rotary floating rod, and the rotary sealing cover is connected, via a connecting member, to an opposing second end of the rotary floating rod.

3. The magnetic suspension drain according to claim 2, wherein the rotary sealing cover is constructed to have an inverted bowl shape convex toward the rotary floating rod, comprising a curved convex part and a ring-shaped connecting part formed at an edge of the curved convex part, and the ring-shaped connecting part is adapted to sealed connection with the drain end of the first connecting member.

4. The magnetic suspension drain according to claim 3, wherein a water guide part is provided on an external surface of the curved convex part, and the water guide part comprises a plurality of ridges extending radially to spread out and deflecting circumferentially, so as to form a spiral texture.

5. The magnetic suspension drain according to claim 3, wherein an inwardly recessed installation part is provided at a center of the curved convex part, and the second end of the rotary floating rod is inserted into the installation part.

6. The magnetic suspension drain according to claim 3, wherein the magnetic suspension drain further comprises a removable collector arranged connectedly inside the first connecting member and attached to the magnetic suspension inner core, wherein the collector is provided with an accommodation cavity suitable for accommodating the rotary floating rod, and the second magnet is arranged at an opening end of the accommodation cavity, causing the rotary floating rod to reciprocate along the accommodation cavity.

7. The magnetic suspension drain according to claim 6, wherein the second magnet is fixed to the opening end of the accommodation cavity through a sealing end cover, and the rotary floating rod is accommodated inside the accommodation cavity through a through hole of the sealing end cover, wherein the first end of the rotary floating rod is provided with an external flange, and in the draining state, the external flange engages with the sealing end cover to limit the moving range of the rotary floating rod.

8. The magnetic suspension drain according to claim 7, wherein the second magnet sleeves over the rotary floating rod, and in the draining state, the external flange abuts the second magnet.

9. The magnetic suspension drain according to claim 6, wherein a ring-shaped internal flange is provided at the drain end of the first connecting member, and the collector is provided with a ring-shaped shoulder for abutting the ring-shaped internal flange.

10. The magnetic suspension drain according to claim 9, wherein the ring-shaped connecting part of the rotary sealing cover is adapted for sealed connection with the end surface of the ring-shaped shoulder of the collector, and an outer diameter of the ring-shaped connecting part is greater than an inner diameter of the ring-shaped shoulder and smaller than an inner diameter of the ring-shaped internal flange of the first connecting member.

11. The magnetic suspension drain according to claim 1, further comprising a spring valve core arranged at the water inlet end of the first connecting member.

12. The magnetic suspension drain according to claim 1, wherein the drain device comprises a basin, a tub, or a water tank.

13. A magnetic suspension drain, comprising a first connecting member and a second connecting member that are connected with each other and adapted to respective connection to a drain opening of a drain device and a drain pipe, a magnetic suspension inner core arranged in the first connecting member, the magnetic suspension inner core comprising a rotary floating rod and a rotary sealing cover connected with the rotary floating rod, wherein the rotary floating rod is provided with a first magnet, a repulsive second magnet is provided inside the first connecting member, wherein the magnetic suspension inner core is configured such that in a sealed state, the rotary floating rod drives the rotary sealing cover to maintain sealing with a drain end of the first connecting member under the action of a repulsive force of the first magnet and the second magnet; and in a draining state, the rotary sealing cover is disengaged from the sealing with the drain end of the first connecting member under the action of water flow and rotates along with the water flow to promote drainage, wherein the first connecting member has a first flange on an outer side of a water inlet end of the first connecting member, the second connecting member has second flange on an outer side of an end of the second connecting member facing the first connecting member, a first seal is achieved by clamping a first sealing ring between the first flange and an upper end surface of the drain opening, and a second seal is achieved by clamping a sealing ring between the second flange and a lower end surface of the drain opening, and a removable collector arranged connectedly inside the first connecting member and attached to the magnetic suspension inner core, wherein the collector is provided with an accommodation cavity suitable for accommodating the rotary floating rod, and the second magnet is arranged at an opening end of the accommodation cavity, causing the rotary floating rod to reciprocate along the accommodation cavity.

14. The magnetic suspension drain according to claim 13, wherein the rotary floating rod is constructed to be a hollow rod, the first magnet is arranged inside the hollow rod or sleeves outside the hollow rod and is adjacent to a first end of the rotary floating rod, and the rotary sealing cover is connected, via a connecting member, to an opposing second end of the rotary floating rod.

15. The magnetic suspension drain according to claim 14, wherein the rotary sealing cover is constructed to have an inverted bowl shape convex toward the rotary floating rod, comprising a curved convex part and a ring-shaped connecting part formed at an edge of the curved convex part, and the ring-shaped connecting part is adapted to sealed connection with the drain end of the first connecting member.

16. The magnetic suspension drain according to claim 15, wherein an inwardly recessed installation part is provided at a center of the curved convex part, and the second end of the rotary floating rod is inserted into the installation part.

17. The magnetic suspension drain according to claim 15, wherein a ring-shaped internal flange is provided at the drain end of the first connecting member, and the collector is provided with a ring-shaped shoulder for abutting the ring-shaped internal flange.

18. The magnetic suspension drain according to claim 17, wherein the ring-shaped connecting part of the rotary sealing cover is adapted for sealed connection with the end surface of the ring-shaped shoulder of the collector, and an outer diameter of the ring-shaped connecting part is greater than an inner diameter of the ring-shaped shoulder and smaller than an inner diameter of the ring-shaped internal flange of the first connecting member.

19. The magnetic suspension drain according to claim 13, wherein the second magnet is fixed to the opening end of the accommodation cavity through a sealing end cover, and the rotary floating rod is accommodated inside the accommodation cavity through a through hole of the sealing end cover, wherein the first end of the rotary floating rod is provided with an external flange, and in the draining state, the external flange engages with the sealing end cover to limit the moving range of the rotary floating rod.

20. The magnetic suspension drain according to claim 19, wherein the second magnet sleeves over the rotary floating rod, and in the draining state, the external flange abuts the second magnet.

* * * * *